US011401153B1

(12) United States Patent
Johnson

(10) Patent No.: US 11,401,153 B1
(45) Date of Patent: Aug. 2, 2022

(54) MANUAL FUEL PUMP

(71) Applicant: Anthony M. Johnson, Sacramento, CA (US)

(72) Inventor: Anthony M. Johnson, Sacramento, CA (US)

( * ) Notice: Subject to any disclaimer, the term of this patent is extended or adjusted under 35 U.S.C. 154(b) by 105 days.

(21) Appl. No.: 17/083,479

(22) Filed: Oct. 29, 2020

(51) Int. Cl.
*B67D 7/60* (2010.01)
*B67D 7/78* (2010.01)
*B67D 7/86* (2010.01)
*B67D 7/04* (2010.01)

(52) U.S. Cl.
CPC ..... *B67D 7/60* (2013.01); *B67D 7/04* (2013.01); *B67D 7/78* (2013.01); *B67D 7/86* (2013.01)

(58) Field of Classification Search
CPC .... F04B 9/14; B67D 7/04; B67D 7/60; B67D 7/645; B67D 7/78; B67D 7/86; B05B 11/3056
USPC ..... 417/425
See application file for complete search history.

(56) References Cited

U.S. PATENT DOCUMENTS 1,242,166 A * 10/1917 Fitzgerald ..... F04B 9/14 248/665
1,742,055 A * 12/1929 Burch ..... F04B 9/14 74/41
2,420,541 A * 5/1947 Jacobs ..... F04B 9/14 74/41
4,630,759 A * 12/1986 Dawn ..... B67D 7/58 222/383.2
6,537,036 B1 3/2003 Broerman et al.
6,558,138 B2 5/2003 Tseng
6,722,855 B2 4/2004 Tien-Tsai
7,093,624 B2 8/2006 Chen
7,163,034 B2 * 1/2007 Franks ..... B67D 7/0205 222/383.2
7,222,984 B2 * 5/2007 Lee ..... H02J 7/32 362/183
7,267,366 B2 9/2007 Hasebe et al.
7,293,587 B1 * 11/2007 Broberg ..... A63H 17/00 141/98
8,245,889 B1 8/2012 Starns
8,360,741 B2 1/2013 Chuang
8,684,236 B2 * 4/2014 Ophardt ..... A47K 5/1217 222/321.9

FOREIGN PATENT DOCUMENTS

JP 2009096516 * 5/2009 ..... B67D 5/64

* cited by examiner

*Primary Examiner* — Timothy L Maust
(74) *Attorney, Agent, or Firm* — Cramer Patent & Design, PLLC; Aaron R. Cramer

(57) ABSTRACT

A manual fuel pump device comprises a crank operated fuel pump in mechanical communication with a spring-loaded hand crank by means of a pump, pulley, and belt system. A dynamo is in mechanical communication with the belt thereby generating a useable electrical current. The device is configured to be an additional component of industry grade fuel dispenser permitting a user to operate the dispenser in the event of an electrical outage.

19 Claims, 4 Drawing Sheets

MANUAL FUEL PUMP

RELATED APPLICATIONS

Nonapplicable.

FIELD OF THE INVENTION

The present invention relates generally to a fuel pump and more specifically to a manual fuel pump.

BACKGROUND OF THE INVENTION

Recent events in the world news such as hurricanes, tsunamis, earthquakes, tornadoes, floods and the like have made us all aware of the massive devastation which can be unleashed by Mother Nature and water. Such damage is widespread and often results in electrical power outages which affects rescue efforts into and out of affected areas. People may be left stranded days or even weeks before help arrives.

Many turn to portable emergency generators for electricity to run refrigerators, freezers, and even air conditioners and furnaces to help keep life near normal. Of course, these generators require fuel to operate along with motor vehicles which are needed for rescue, evacuation, and recovery efforts. Unfortunately, fueling stations are affected in the same manner, and lack of electrical power means that even stations with full underground tanks are unable to dispense life-saving fuel.

Accordingly, there exists a need for a means by which fueling stations suffering from an electrical power outage can remain able to pump and dispense fuel. The use of the manual fuel pump provides the ability to dispense and utilize life-saving fuel during times of power outages in a manner which is quick, easy, and effective.

SUMMARY OF THE INVENTION

To achieve the above and other objectives, a manual fuel pump system has a pump which is located on a pad that is capable of being mounted to a surface, a fuel reservoir which is in fluid communication with the pump, a pump shaft which has a first end and a second end, a pump pulley which drives the second end of the pump shaft, a drive pulley operably driving the pump pulley via a belt, a drive shaft which has a first end and a second end, a crank arm which has a first end and a second end, a crank arm shaft which has a first end and a second end, a dynamo which is mounted to a support structure such that it is in-line with the belt and is driven and an enclosure which provides environmental and physical protection of the manual fuel pump system. The first end of the pump shaft drives the pump. The pump pulley aids in reducing tension on the belt. The drive shaft passes through the center of the drive pulley and operably drives the drive pulley. The first end of the crank arm is attached to a crank arm handle that extends perpendicularly away. The second end of the crank arm is attached to the first end of the crank arm shaft. The dynamo generates a modicum of direct current that is capable of powering a downstream device.

The fuel reservoir may be an auxiliary reservoir from a conventional onsite in-ground fuel tank located adjacent to the pump. The fuel reservoir may be inside the enclosure with the pump. The fuel reservoir may be an off-take from a shared in-ground fuel tank that is only accessible when power is cut-off from a conventional fuel pumping system. Power may be cut-off from the conventional fuel pumping system by a closed solenoid valve. The drive pulley and the pump pulley may be located to provide a nearly frictionless transfer of power via the belt.

The drive pulley may be mounted adjacent to the pump. The pump pulley and the drive pulley may have one or more extended flanges to maintain retention of the belt thereon to reduce slack. Each of a pair of bearings may be located on opposite sides of the drive pulley. The drive shaft may be routed through each of the pair of bearings and is independently rotated relative to the same. The pair of bearings may be capable of being mounted to the support structure. The pump pulley and the drive pulley may have a plurality of teeth. The pump pulley and the drive pulley may be without the teeth. The first end of the drive shaft may extend out of the side of the drive pulley and is manually operated.

The second end of the drive shaft may be affixed to the support structure, such that it is capable of independent rotation. The crank arm handle is independently rotatable from the crank arm to aid in an ergonomic manual rotation. The crank arm shaft may extend perpendicularly away from the crank arm in an opposite direction from the crank arm handle. The dynamo may be directed into a power conditioning unit to filter, condition and regulate a plurality of variable power produced by the dynamo from hand cranking.

The variable power produced by the dynamo may be fed into a deep cycle battery that stores power so that light will be provided within the enclosure at all times. The second end of the crank arm shaft may be removably attached to the first end of the drive shaft therefore resulting in manual rotation of the crank arm. The crank arm shaft may grasp the crank arm handle to transfer a rotational motion to the drive shaft and the drive pulley, which then transfers a linear motion to the belt, which then transfers a rotational motion to the pump pulley and the pump shaft to drive the pump to transfer a plurality of fuel from the reservoir to an outlet hose and nozzle.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTIVE KEY

Figure 1:
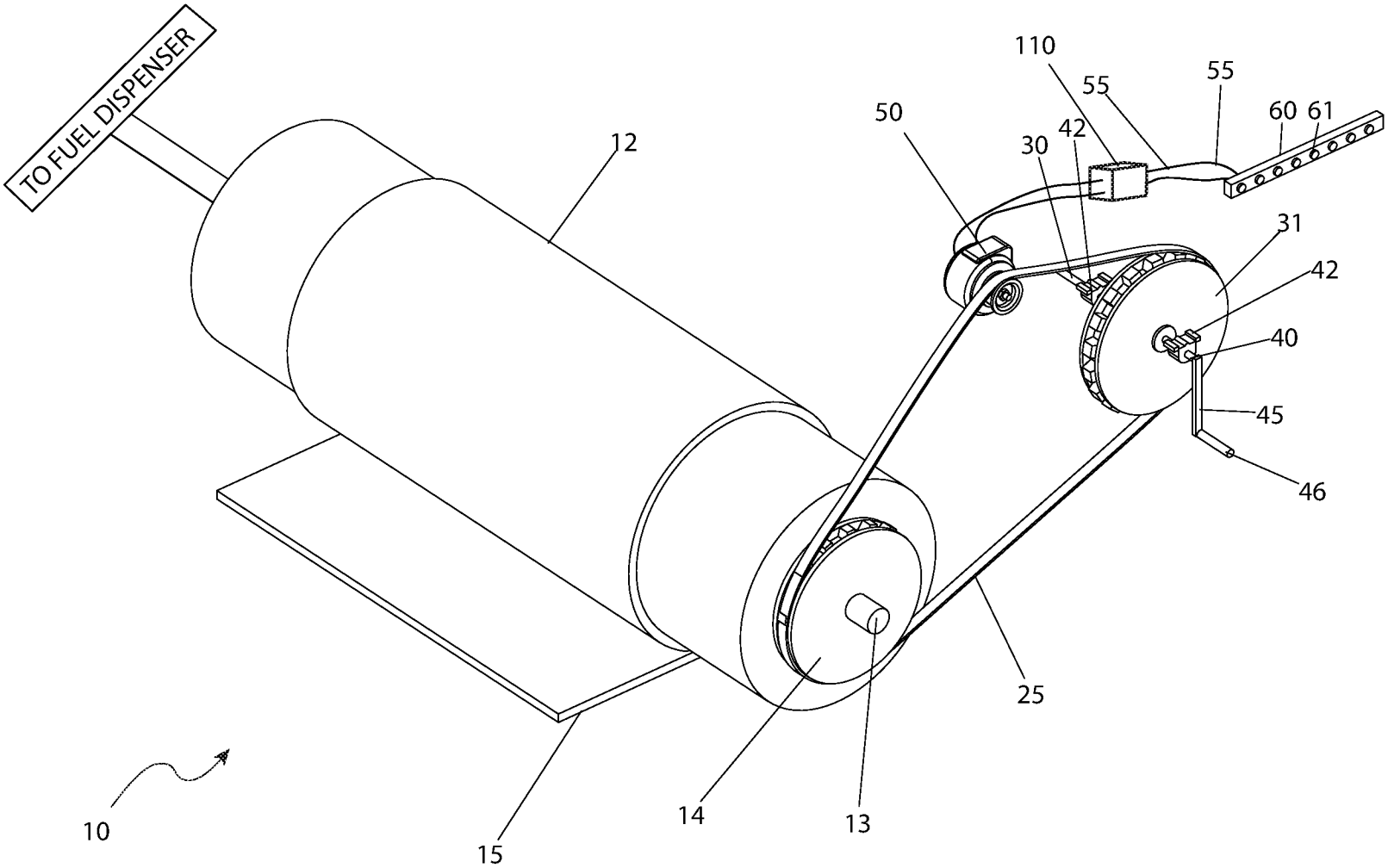
FIG. 1 is a schematic of a manual fuel pump system 10, according to the preferred embodiment of the present invention.

10 manual fuel pump system
12 pump
13 pump shaft
14 pump pulley
15 pad
25 belt

30 drive shaft
31 drive pulley
40 crank arm shaft
42 bearing
45 crank arm
46 crank arm handle
50 dynamo
55 wiring
60 light strip
61 lamp
70 fuel tank
75 fill port
80 vent line
85 suction line
90 pressure line
95 flexible hose
100 dispensing nozzle
105 enclosure
110 electrical components
115 light switch
120 power conditioning circuit
125 charge controller
130 deep cycle battery
135 driver circuit

DESCRIPTION OF THE INVENTION

The best mode for carrying out the invention is presented in terms of its preferred embodiment, herein depicted within FIGS. 1 through 4. However, the invention is not limited to the described embodiment, and a person skilled in the art will appreciate that many other embodiments of the invention are possible without deviating from the basic concept of the invention and that any such work around will also fall under scope of this invention. It is envisioned that other styles and configurations of the present invention can be easily incorporated into the teachings of the present invention, and only one (1) particular configuration shall be shown and described for purposes of clarity and disclosure and not by way of limitation of scope. All of the implementations described below are exemplary implementations provided to enable persons skilled in the art to make or use the embodiments of the disclosure and are not intended to limit the scope of the disclosure, which is defined by the claims.

The terms "a" and "an" herein do not denote a limitation of quantity, but rather denote the presence of at least one (1) of the referenced items.

DETAILED DESCRIPTION OF THE FIGURES

Referring now to FIG. 1, there is depicted a schematic of a manual fuel pump system (herein described as the "system") 10. The system 10 is a hand-powered fuel pumping station designed for use at fuel stations during power outages to allow for the dispensing of fuel. During times of emergency, when power is cut off from conventional fuel pump systems, the system 10 can be utilized manually.

The system 10 generally comprises of a pump 12 located on a pad 15 that is capable of being mounted to a surface. The pump 12 is in fluid communication with a fuel reservoir (not shown) that can be an auxiliary reservoir from the conventional on-site in-ground fuel tanks located adjacent to, or in a similar housing in conjunction with the pump 12, or it can be an off-take from the same in-ground fuel tank that is only accessible when power is cut-off from the conventional pumping system (e.g., normal-closed solenoid valve). The pump 12 has a pump shaft 13, wherein a first end thereof drives the pump 12 and a pump pulley 14 that drives the pump shaft 13.

A drive pulley 31 is mounted adjacent the pump 12 and operably drives the pump pulley 14 via a belt 25. A drive shaft 30 passes through the center of and operably drives the drive pulley 31. A first end of the drive shaft 30 extends out of the first side of the drive pulley 31 and is capable of being manually operated. A second end of the drive shaft 30 can be affixed to a support structure, such that it is capable of independent rotation therefrom. It is preferred that the drive pulley 31 and the pump pulley 14 are located in such a manner as to provide a proper and relatively frictionless transfer of power via the belt 25. The pulleys 14, 31 can be toothed or not, and may or may not have extended flanges to maintain the retention of the belt 25 thereon with a minimal of slack. At least one (1) bearing 42 is located on either side of the drive pulley 31. In a preferred embodiment, there are two (2) bearings 42, each located on opposite sides of the drive pulley 31. The drive shaft 30 is routed through each of the bearings 42 and are capable of independent rotation relative thereto. The bearings 42 are also capable of being mounted to a support structure.

A crank arm 45 has a first end and a second end. A first end of the crank arm is attached to a crank arm handle 46 that extends perpendicularly away therefrom. The crank arm handle 46 is preferably independently rotatable from the crank arm 45 to aid in an ergonomic manual rotation thereof. A second end of the crank arm 45 is attached to a first end of a crank arm shaft 40. The crank arm shaft 40 extends perpendicularly away from the crank arm 45 and in an opposite direction from the crank arm handle 46. A second end of the crank arm shaft 40 is capable of being removably attached to the first end of the drive shaft 30. Therefore, manual rotation of the crank arm 45 and crank arm shaft 40 by a user grasping the crank arm handle 46 transfers a rotational motion to the drive shaft 30 and drive pulley 31, which transfers a linear motion to the belt 25, which transfers a rotational motion to the pump pulley 14 and pump shaft 13 to drive the pump 12 to transfer fuel from the reservoir to the outlet piping or hose and nozzle and ultimately to the final destination. The pump pulley 14 aids in providing minimal tension on the belt 25 and to minimize slack thereof.

In a preferred embodiment, a dynamo 50 can be mounted to a support structure such that it is in-line with the belt 25 and driven thereby. The dynamo 50 is capable of generating a modicum of electricity in the form of direct current to power a downstream device through multiple electrical components 110, which will be described in greater detail herein below. Such a downstream device can be a light strip 60 comprising a plurality of lamps 61 delivered via electrical wiring 55. In other embodiments, a magneto (not shown) instead of a dynamo 50 can be mounted to provide alternating current (AC) to a downstream device.

Figure 2:
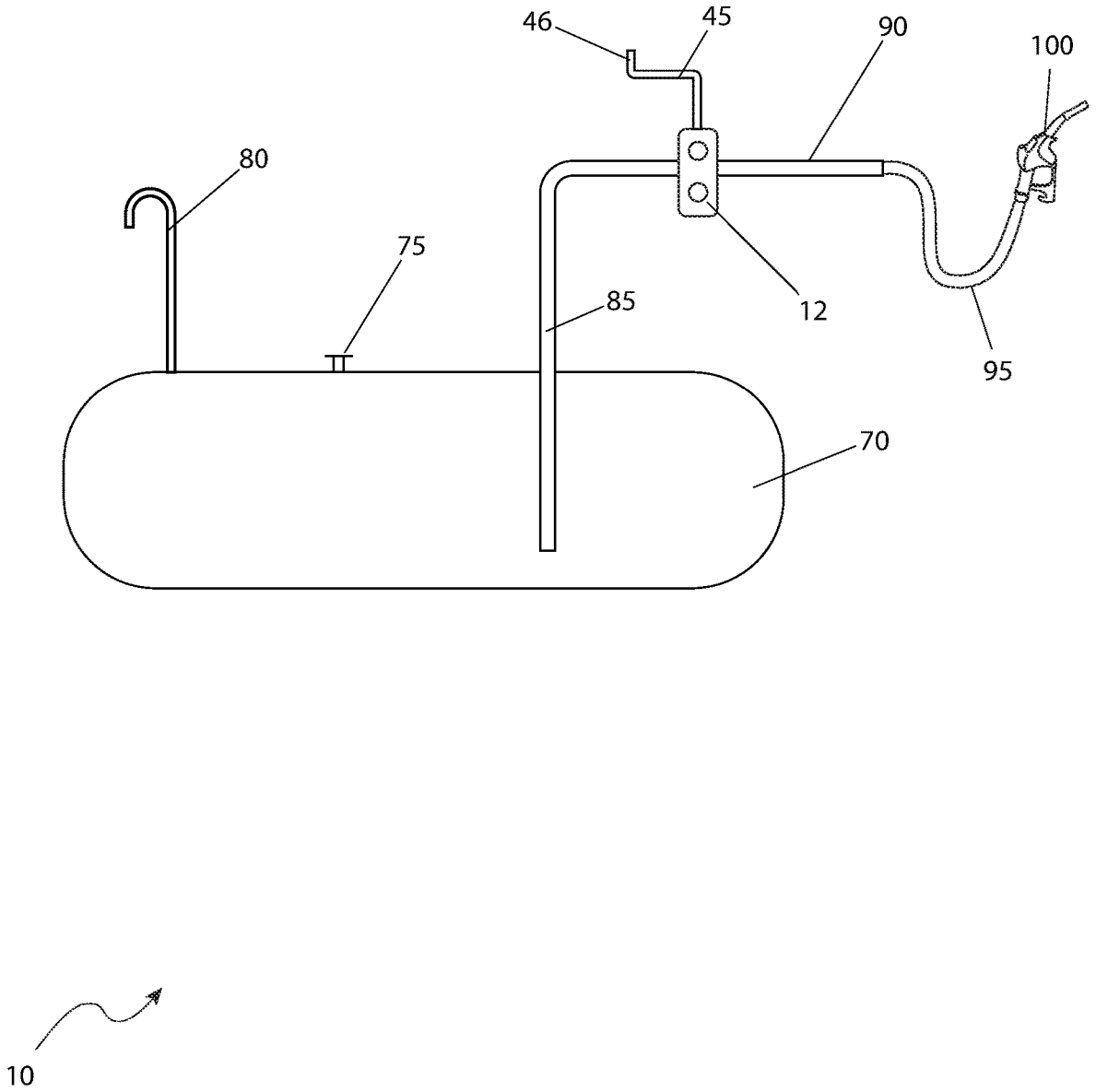
FIG. 2 is a process flow diagram of a manual fuel pump system 10, according to the preferred embodiment of the present invention.

Referring next to FIG. 2, a process flow diagram of a system 10, according to the preferred embodiment of the present invention is disclosed. A fuel tank 70 is provided in either an above ground or below ground location and is provided with a fill port 75 and a vent line 80 as would be customarily expected. A suction line 85 is provided into the bottom of the fuel tank 70 and is interconnected to the pump 12, here shown as a positive displacement pump. It is noted that many different types of positive displacement pumps such as piston pumps, plunger pumps, and the like. As such, the specific use of any particular type or style of pump is not intended as a limiting factor of the present invention. The pump 12 is driven by the crank arm 45 and crank arm handle 46 as aforementioned described. The output of the pump 12 is connected to a pressure line 90, a flexible hose 95 and eventually a dispensing nozzle 100 where it can be used to fill a vehicle, portable storage can, or the like.

Figure 3:
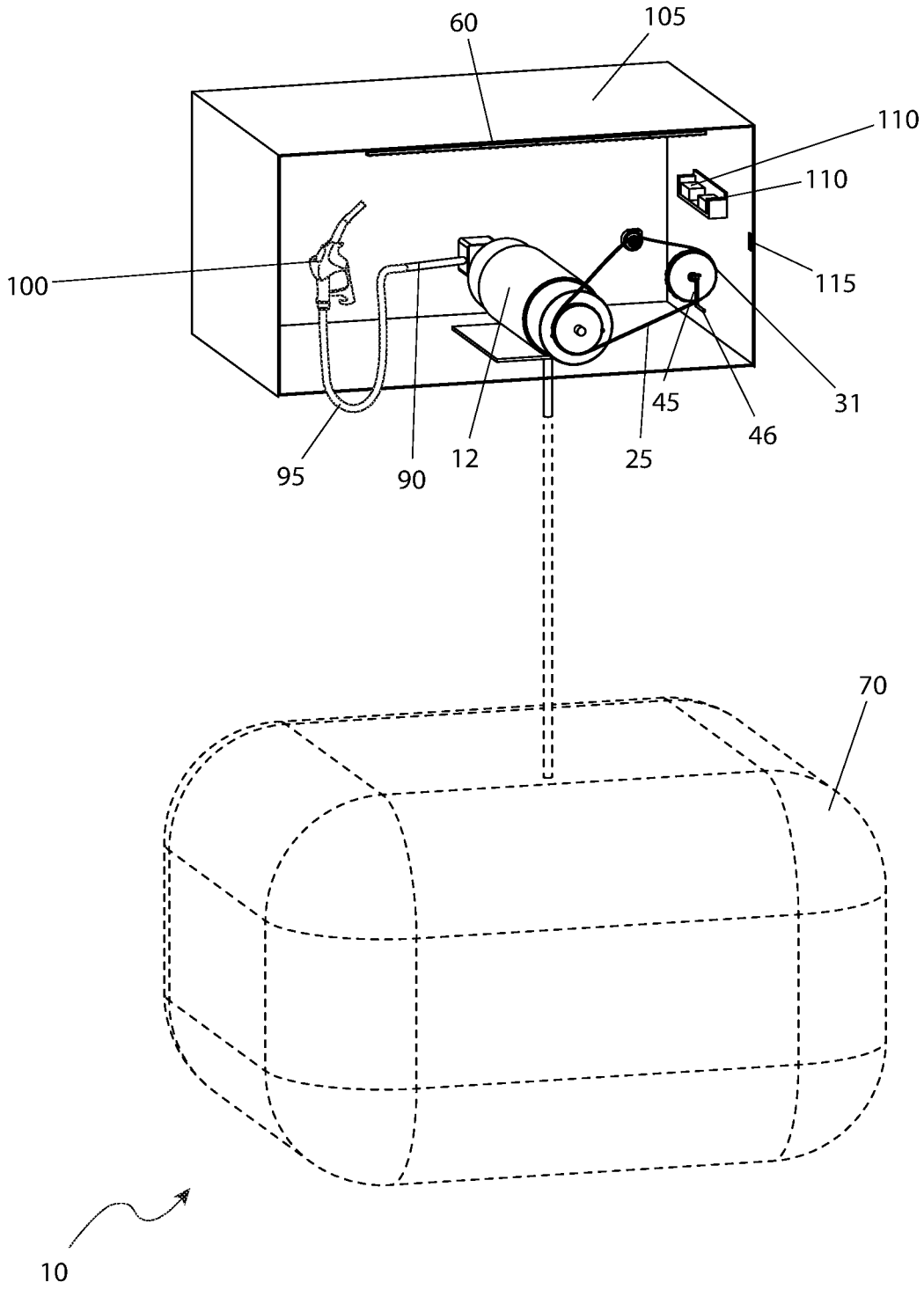
FIG. 3 is an environmental view of a manual fuel pump system 10, according to the preferred embodiment of the present invention.

Referring now to FIG. 3, an environmental view of a system 10, according to the preferred embodiment of the present invention is depicted. An enclosure 105 is provided for environment and physical protection of the components of the system 10. The enclosure 105 is envisioned to be approximately three feet (3 ft.) wide, four feet (4 ft.) tall and two feet (2 ft.) deep. The pump 12 is positioned above the fuel tank 70 shown in a typical underground position. The crank arm 45 and crank arm handle 46 are connected to the drive pulley 31 and interconnected to the pump 12 by the belt 25. The output of the pump 12 is routed by the pressure line 90 to a flexible hose 95 and the dispensing nozzle 100. Multiple electrical components 110 are positioned inside of the enclosure 105 and are electrically connected to the light strip 60 overhead through a light switch 115.

Figure 4:
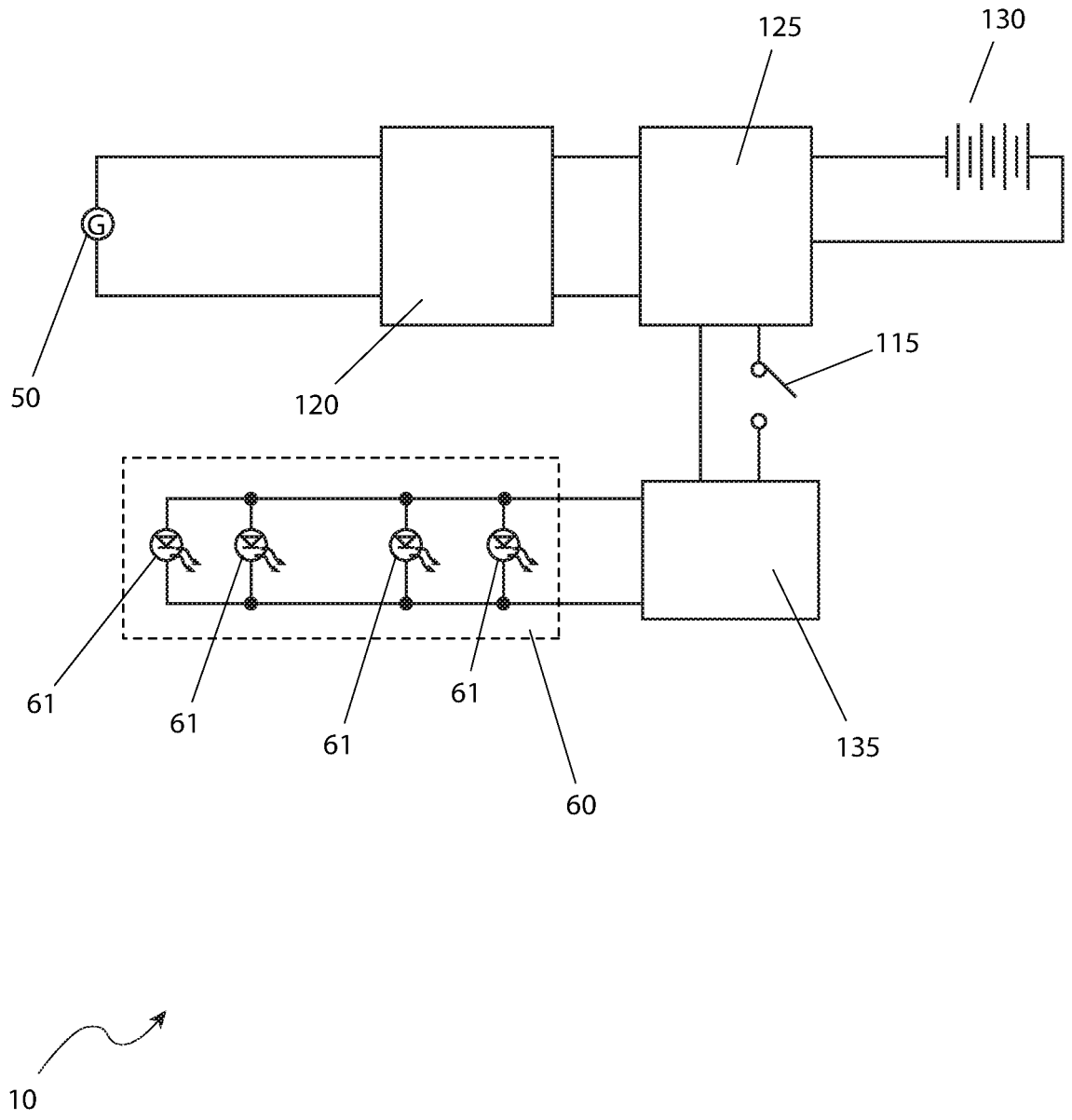
FIG. 4 is an electrical block diagram of the electrical components used in the manual fuel pump system 10, according to the preferred embodiment of the present invention.

Referring finally to FIG. 4 is an electrical block diagram of the electrical components used in the system 10, according to the preferred embodiment of the present invention is shown. The dynamo 50 is envisioned to produce DC power that it directed into a power conditioning unit 120 to filter, condition and regulate the variable power produced by the dynamo 50 under hand cranking conditions. The resultant conditioned power is fed into a deep cycle battery 130. The deep cycle battery 130 stores power so that light will be produced at the enclosure 105 (as shown in FIG. 3) at all times and not just when the crank arm 45 and the crank arm handle 46 are being cranked. Output power from the charge controller 125 is then passed through the light switch 115 for control into a driver circuit 135 which then feeds the individual lamps 65 within the light strip 60. As such, task lighting is made available at the enclosure 105 for purposes of filling vehicles, portable electric generators, portable fuel cans, and the like.

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated.

What is claimed is:

1. A manual fuel pump system, comprising:

a pump located on a pad that is capable of being mounted to a surface;

a fuel reservoir in fluid communication with the pump;

a pump shaft having a first end and a second end, the first end of the pump shaft drives the pump;

a pump pulley driving the second end of the pump shaft;

a drive pulley operably driving the pump pulley via a belt, the pump pulley aids in reducing tension on the belt;

a drive shaft having a first end and a second end, the drive shaft passes through the center of the drive pulley and operably drives the drive pulley;

a crank arm having a first end and a second end, the first end of the crank arm is attached to a crank arm handle that extends perpendicularly away therefrom;

a crank arm shaft having a first end and a second end, the second end of the crank arm shaft being removably attached to the first end of the drive shaft, the second end of the crank arm is attached to the first end of the crank arm shaft;

a dynamo mounted to a support structure such that it is in-line with the belt and is driven thereby, the dynamo generates a modicum of direct current that is capable of powering a downstream device; and an enclosure providing environmental and physical protection of the manual fuel pump system.

2. The manual fuel pump system, according to claim 1, wherein the fuel reservoir is an auxiliary reservoir from a conventional onsite in-ground fuel tank located adjacent to the pump.

3. The manual fuel pump system, according to claim 1, wherein the fuel reservoir is inside the enclosure with the pump.

4. The manual fuel pump system, according to claim 1, wherein the fuel reservoir is an off-take from a shared in-ground fuel tank that is only accessible when power is cut-off from a conventional fuel pumping system.

5. The manual fuel pump system, according to claim 4, wherein power is cut-off from the conventional fuel pumping system by a closed solenoid valve.

6. The manual fuel pump system, according to claim 1, wherein the drive pulley and the pump pulley are located to provide a nearly frictionless transfer of power via the belt.

7. The manual fuel pump system, according to claim 6, wherein the drive pulley is mounted adjacent to the pump.

8. The manual fuel pump system, according to claim 1, wherein the pump pulley and the drive pulley have one or more extended flanges to maintain retention of the belt thereon to reduce slack.

9. The manual fuel pump system, according to claim 1, wherein each of a pair of bearings are located on opposite sides of the drive pulley.

10. The manual fuel pump system, according to claim 9, wherein the drive shaft is routed through each of the pair of bearings and is independently rotated relative thereto.

11. The manual fuel pump system, according to claim 9, wherein the pair of bearings are capable of being mounted to the support structure.

12. The manual fuel pump system, according to claim 1, wherein the pump pulley and the drive pulley have a plurality of teeth.

13. The manual fuel pump system, according to claim 12, wherein the pump pulley and the drive pulley are without the teeth.

14. The manual fuel pump system, according to claim 1, wherein the first end of the drive shaft extends out of the side of the drive pulley and is manually operated.

15. The manual fuel pump system, according to claim 1, wherein the second end of the drive shaft is affixed to the support structure, such that it is capable of independent rotation therefrom.

16. The manual fuel pump system, according to claim 1, wherein the crank arm handle is independently rotatable from the crank arm to aid in an ergonomic manual rotation thereof.

17. The manual fuel pump system, according to claim 1, wherein the crank arm shaft extends perpendicularly away from the crank arm in an opposite direction from the crank arm handle.

18. The manual fuel pump system, according to claim 1, wherein the dynamo is directed into a power conditioning unit to filter, condition and regulate a plurality of variable power produced by the dynamo from hand cranking.

19. The manual fuel pump system, according to claim 18, wherein the variable power produced by the dynamo is fed into a deep cycle battery that stores power so that light will be provided within the enclosure at all times.

* * * * *